United States Patent [19]

Chien

[11] Patent Number: 4,549,542

[45] Date of Patent: Oct. 29, 1985

[54] MULTIPLE-EFFECT RESPIRATOR

[76] Inventor: Chao-Huei Chien, P.O. Box 10160, Taipei, Taiwan

[21] Appl. No.: 516,687

[22] Filed: Jul. 25, 1983

[51] Int. Cl.[4] ..... A62B 7/00

[52] U.S. Cl. ..... 128/201.24; 128/201.25; 128/205.12; 128/205.25

[58] Field of Search ..... 128/201.21–201.26, 128/200.27, 205.12, 205.25, 205.29, 206.16, 206.17, 200.28, 206.12

[56] References Cited

U.S. PATENT DOCUMENTS

| | | | |
|---|---|---|---|
| 3,657,740 | 4/1972 | Cialone | 128/205.25 |
| 3,736,927 | 6/1973 | Misaqi | 128/201.25 |
| 3,822,698 | 7/1974 | Guy | 128/201.25 |
| 4,233,972 | 11/1980 | Hauff et al. | 128/205.12 |
| 4,280,491 | 7/1981 | Berg et al. | 128/201.24 |

FOREIGN PATENT DOCUMENTS

| | | | |
|---|---|---|---|
| 26740 | 8/1968 | German Democratic Rep. | 128/200.27 |
| 585885 | 2/1947 | United Kingdom | 128/200.27 |

*Primary Examiner*—Henry J. Recla
*Assistant Examiner*—Karin M. Reichle

[57] ABSTRACT

A respirator includes a driving motor, a supplying air fan, an exhausting air fan, two ventilating air fans and a mask formed within a facepiece wherein the supplying air fan is driven by the motor to direct fresh air into the mask and the exhausting fan is also driven by the motor to discharge the waste air in mask for providing comfortable breathing for the wearer and the two ventilating fans are driven by motor to suck in fresh air and directs it into the helmet for comforting wearer's head.

3 Claims, 4 Drawing Figures

MULTIPLE-EFFECT RESPIRATOR

BACKGROUND OF THE INVENTION

Conventional oxygen-generating apparatuses or air line respirators are quite complex in construction and are expensive especially for the poorer users. Since there is no effective forced draft provided in a conventional respirator to release the exhaled air, the ventilation of such a conventional respirator is thus poorer.

The present inventor has found this defect of conventional respirators and invented the present multiple-effect respirator to overcome this defect.

SUMMARY OF THE INVENTION

The object of the present invention is to provide a respirator comprising a driving motor, a supplying air fan, an exhausting air fan, two ventilating air fans and a mask formed in a facepiece wherein the supplying air fan is driven by the motor to direct fresh air into the mask, the exhausting fan is also driven by the motor to discharge the waste air accumulated in the mask for providing comfortable breathing for the wearer and the two ventilating fans are driven by motor to suck in fresh air and direct it into the helmet for comforting wearer's head.

DETAILED DESCRIPTION

Figure 1:
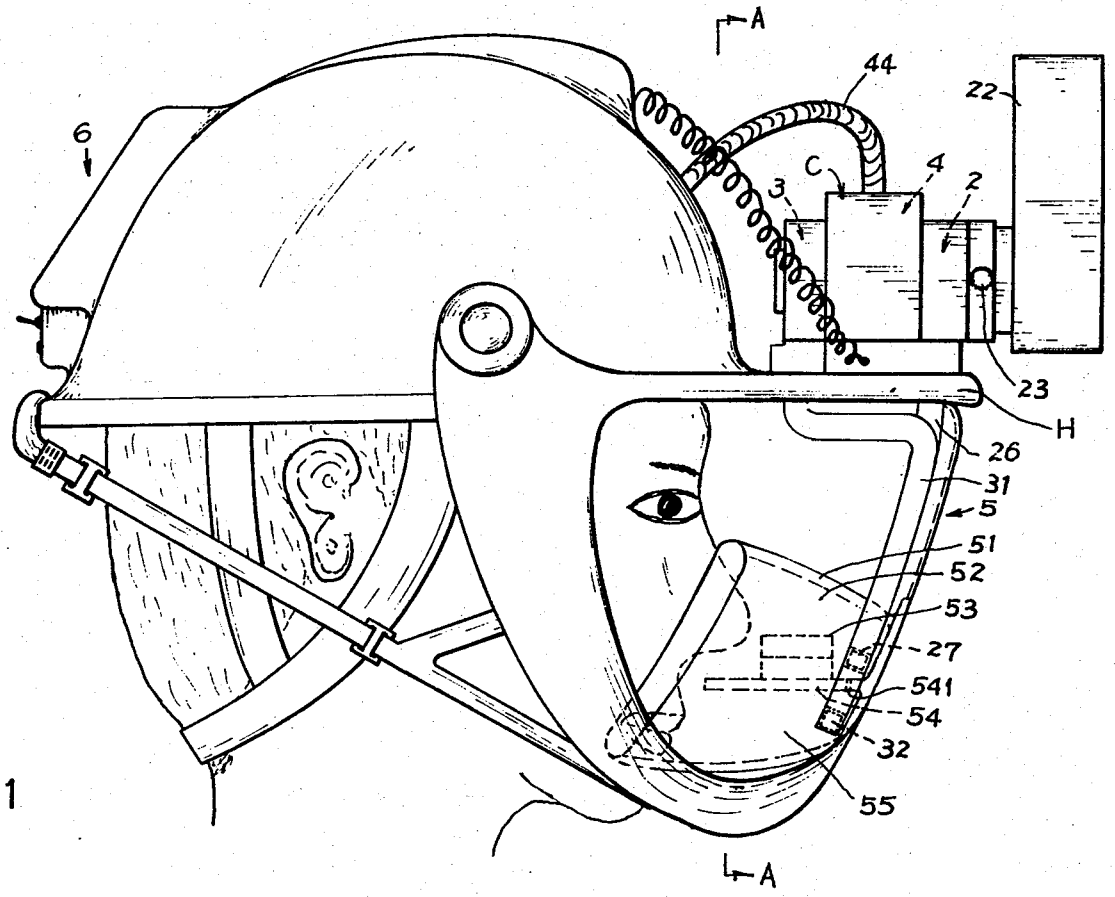
FIG. 1 is an illustration showing the present invention mounted on wearer's helmet.
Figure 3:
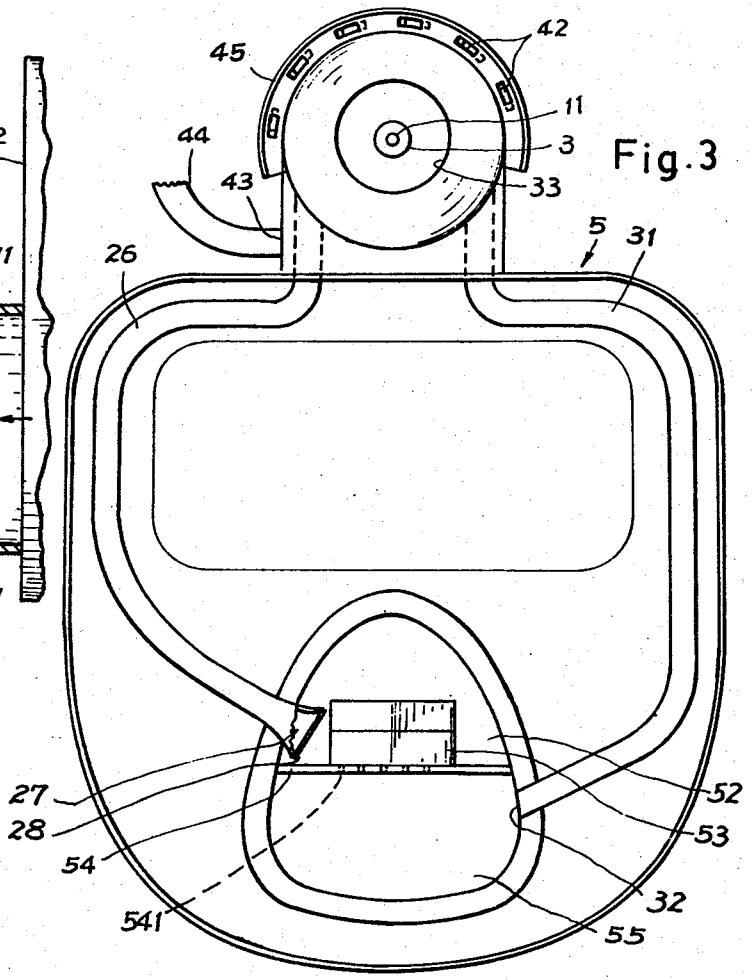
FIG. 3 is an illustration taken from direction AA of FIG. 1 in accordance with the present invention.
Figure 2:
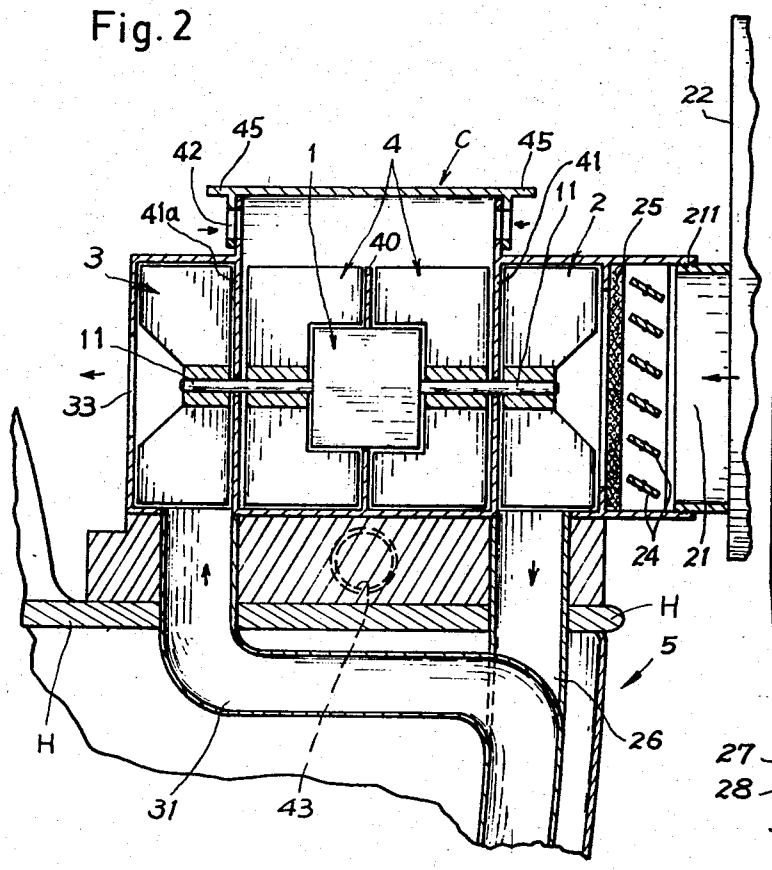
FIG. 2 is a partial sectional drawing of the present invention.

As shown in FIGS. 1, 2 and 3, the present invention comprises a driving motor 1, a supplying air fan 2, an exhausting air fan 3, two ventilating air fans 4 and a facepiece 5 having a mask 51 which is formed in facepiece 5 to correspond with the wearer's nose and mouth. All fans 2, 3, 4 are respectively fixed on a shaft 11 of driving motor 1. All fans and the motor are fixed in a housing C mounted on the helmet H. The supplying air fan 2 and a ventilating air fan 4 are positioned on one side of motor 1 and the exhausting air fan 3 and the other ventilating air fan 4 are positioned on the opposite side of motor 1. Both ventilating air fans 4 are separated by a partition plate 40 centrally formed on motor 1. Supplying fan 2 is separated from the one ventilating fan 4 by a partition plate 41. However, exhausting fan 3 is separated from the other ventilating fan 4 by another partition plate 41*a* opposite to partition plate 41. An air entrance port 21 fluidically communicated with supplying fan 2 which has a thread 211 for connecting a canister 22 for air filtration. In front of fan 2, there is also provided a louver 24 for adjusting the opening of air entrance by an adjusting knob 23 (not shown), and is provided with a filter 25 for dust screening. An air delivery tube 26 is provided to direct the air blown by supplying fan 2 into mask 51 formed in facepiece 5. Tube 26 is formed with an expansion portion 27 within mask 51. A perforated cap 28 is provided on expansion portion 27 to diffuse air to the wearer.

Mask 51 is provided with a partition plate 54 to form an upper chamber 52 and a lower chamber 55. Partition plate 54 is formed with several perforations 541. Air delivery tube 26 is led into upper chamber 52 to fluidically communicate with the wearer's nose. A cassette 53 filled with stimulant or air refreshing agent is formed on the upper chamber 52 to comfort the wearer while breathing. An air discharge tube 31 is provided which fluidically communicates through outlet port 32 with the lower chamber 55 of the mask 51 to permit the exhausting fan to suck air therefrom. The waste air as sucked therefrom by fan 3 is discharged through an outermost port 33 at the outlet by fan 3.

The two ventilating air fans 4 are disposed on opposite sides of motor 1. An air entrance port 42 is formed on housing C atop both fans 4. Port 42 may be provided with an adjusting means for adjusting the incoming air rate. A discharge port 43 is formed on the lower part of housing C opposite to air entrance port 42 and is connected with a flexible air hose 44 to lead the air into helmet H to comfort the wearer's head. The housing is provided with the top roof 45 to protect the fans and the motor from rain.

Figure 4:
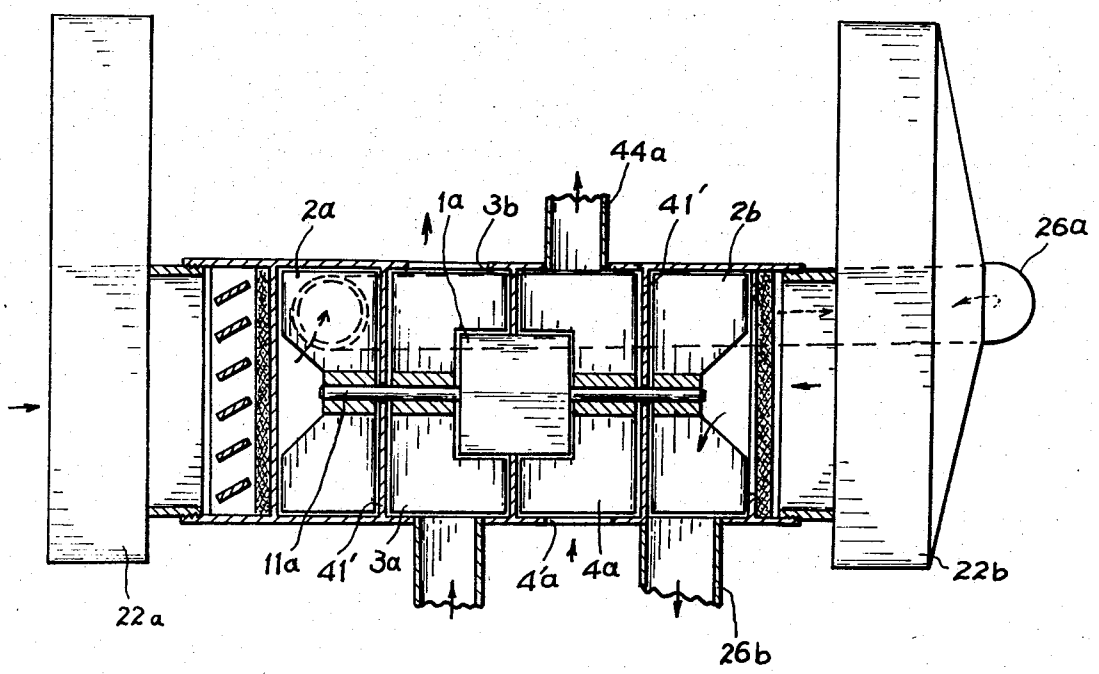
FIG. 4 is a partial sectional illustration showing another preferred embodiment of the present invention.

Another preferred embodiment of the present invention is shown in FIG. 4. The structure of such an embodiment is similar to that as afore-mentioned except two canisters 22*a*, 22*b* are disposed on opposite sides of the fans. The driving motor 1*a* provides a shaft 11*a* for fixing two supplying air fans 2*a*, 2*b*; an exhausting fan 3*a* and a ventilating fan 4*a*.

Two partition plates 41' are provided so that one plate separates the supplying fan 2*a* from exhausting fan 3*a* and another plate separates another supplying fan 2*b* from ventilating fan 4*a*. The air sucked from fan 2*a* is filtered through first canister 22*a* and is then led through tube 26*a* into second canister 22*b* for further poison filtration. The fresh air is then delivered through tube 26*b* to mask 51 for breathing by the wearer. The waste air is sucked from the mask by exhausting fan 3*a* and discharged through port 3*b*. The ventilating fan 4*a* sucks the air through inlet port 4*a'* and directs the air into wearer's helmet through discharge tube 44*a*.

The power source 6 electrically connected with motor 1 is fitted on the rear portion of helmet to balance the fans and motor fixed on the front portion thereof. The facepiece 5 is pivotedly mounted on the helmet H.

The present invention is superior to conventional respirator as follows:

1. The supply of fresh air and discharge of waste air is operated in forced ventilation for more comfortable working environment.
2. A cassette of stimulant or refreshing agent is provided for further cleaning the air and exciting the wearer's spirit.
3. The present invention is compact in structure and small in volume for easier wearing and lower production cost.

I claim:

1. A multiple effect respirator comprising:

a driving motor having a shaft extending through opposite sides of said motor adapted for receiving fans thereon;

a supplying air fan fixed on the motor shaft on one side of said motor;

an exhausting air fan fixed on the motor shaft on the opposite side of said motor;

two ventilating fans fixed on the motor shaft at opposite sides of the motor, respectively, and adjacent thereto;

a housing having first and second opposite end walls and side wall means extending therebetween, said end walls and side wall means defining a chamber therebetween, said fans and said motor mounted within said chamber with said exhausting fan and said supplying fan adjacent the first and second opposite end walls, respectively, said first end wall having exhaust means therein for permitting discharge of air from the exhausting fan and said second end wall having filtering means connected thereto for permitting delivery of filtered air to said supplying fan, said housing further provided with first partition means mounted within the housing chamber between said exhausting fan and the ventilating fan adjacent thereto for defining an exhaust chamber with the side wall means and the first end wall of said housing and second partition means mounted within the housing chamber between said supplying fan and the ventilating fan adjacent thereto for defining a supply chamber with the side wall means and the second end wall of said housing, said first and second partition means further defining a ventilating chamber between the exhaust chamber and supply chamber, said exhaust chamber having an air inlet therein, said supply chamber having an air outlet therein and said ventilating chamber having an air inlet in fluid communication with ambient and an air outlet therein;

a helmet adapted to cover the top of user's head having a front portion and a rear portion adapted for positioning adjacent the front and rear portions of a user's head, respectively, said housing mounted on the front portion of said helmet, said helmet provided with a facepiece pivotally mounted across the front portion thereof and adapted to overlie the user's face in spaced relationship thereto, said facepiece having an oronasal mask adapted to cover the user's nose and mouth mounted thereon at the portion of said face piece adapted to overlie the nose and mouth of the user; a power source electrically connected with said motor and mounted on the rear portion of the helmet;

an air delivery tube connected to the outlet of said supply chamber and the mask on said facepiece;

an air discharge tube connected to the air inlet of said exhaust chamber and the mask on said facepiece; and air delivery means connected to the outlet of the ventilating chamber and the helmet for delivering of air from the ventilating chamber to the interior of the helmet, whereby when said motor is actuated, air is drawn by supplying fan from ambient through said filtering means into said supply chamber, directed out of said supply chamber into the air delivery tube and delivered to the mask, air exhaled by the user is withdrawn from the mask by said exhausting fan through said air discharge tube into said exhaust chamber and discharged from the exhaust chamber through said exhaust means and air is drawn into the ventilating chamber from the ambient by the ventilating fans and directed out of the ventilating chamber into the air delivery means and delivered to the helmet.

2. A respirator according to claim 1, wherein said mask in said facepiece is provided with a partition plate mounted in and horizontally across said mask to define an upper chamber adapted to cover the user's nose and a lower chamber adapted to cover the user's mouth, said air delivery tube connected to the upper chamber of the mask and said air discharge tube connected to the lower chamber of the mask, and a cassette filled with a refreshing agent being provided in said upper chamber.

3. A respirator according to claim 2, wherein said partition plate includes perforations therethrough and said air delivery tube connected to the mask includes means for diffusing air formed therein for diffusing the air delivered by said air delivery tube to the mask within the upper chamber of the mask.

* * * * *